United States Patent [19]

Guèble et al.

[11] Patent Number: 4,939,489

[45] Date of Patent: Jul. 3, 1990

[54] FILTER HAVING A DIELECTRIC RESONATOR

[75] Inventors: Jean-Michel Guèble, Colomiers; Bernard Théron, Saint-Orens; Yannick Latouche, Legueuin; Jean-Bernard Ducrocq, Ramonville Saint Agne, all of France

[73] Assignee: Alcatel Espace, Courbevoie, France

[21] Appl. No.: 310,117

[22] Filed: Feb. 13, 1989

[30] Foreign Application Priority Data

Feb. 12, 1988 [FR] France ..... 88 01696

[51] Int. Cl.[5] ..... H01P 1/207; H01P 7/10

[52] U.S. Cl. ..... 333/202; 333/219.1; 333/227; 333/229; 333/234

[58] Field of Search ..... 333/202, 219, 209, 219.1, 333/227, 232, 233, 235, 229, 234

[56] References Cited

U.S. PATENT DOCUMENTS

| | | | |
|---|---|---|---|
| 3,249,890 | 5/1966 | Beaty | 331/98 |
| 3,636,480 | 1/1972 | Hoeck | 333/230 |
| 4,318,064 | 3/1982 | Käch | 333/219.1 X |
| 4,437,073 | 3/1984 | Thal, Jr. | 333/227 X |
| 4,460,896 | 7/1984 | Shmitka | 333/235 X |
| 4,535,308 | 8/1985 | Znojkiewicz | 333/232 |
| 4,630,009 | 12/1986 | Tang | 333/28 R |

FOREIGN PATENT DOCUMENTS

| | | |
|---|---|---|
| 2391569 | 12/1978 | France . |
| 0194363 | 11/1982 | Japan . |
| 0176905 | 10/1984 | Japan . |
| 0176906 | 10/1984 | Japan . |
| 0218202 | 9/1986 | Japan . |
| 0882408 | 11/1961 | United Kingdom . |

*Primary Examiner*—Eugene R. LaRoche
*Assistant Examiner*—Seung Ham
*Attorney, Agent, or Firm*—Sughrue, Mion, Zinn, Macpeak & Seas

[57] ABSTRACT

A filter having a dielectric resonator, the filter comprising at least one cylindrical cavity (10) containing a cylindrical dielectric resonator (11) whose axis of symmetry (Δ) is colinear with the axis of said cavity (10), and the resonator being held in a longitudinally asymmetrical position inside said cavity (10) by a mandrel system which clamps around the cylindrical portion thereof and which includes at least one spoke for fixing it to said cavity while leaving play relative to said cavity.

8 Claims, 2 Drawing Sheets

FILTER HAVING A DIELECTRIC RESONATOR

The invention relates to a filter having a dielectric resonator.

BACKGROUND OF THE INVENTION

Such a filter is based on the following principles:

using the modes of a metal-clad dielectric resonator; and reusing conventional excitation methods and coupling modes, in particular by virtue of adjustment screws acting on the electric field and coupling irises using the magnetic field.

An article published in "Electronics Letters", vol. 16, No. 17, August 14, 1980, pp. 646–647, entitled "Dielectric resonator dual mode filter" by P. Guillon, Y. Garault, and J. Farenc describes a metal-clad dielectric resonator which is cylindrical in shape and in which a plurality of degenerative modes at identical natural frequencies can propagate. These degenerate modes may be mutually coupled in order to form coupled circuits, by disturbing the geometrical configuration of the structure. It is thus possible to disturb the frequency for the $TE_{01p}$ mode by means of a tuning screw, together with a two-mode dielectric filter using two $HE_{111}$ modes of the resonator which are polarized perpendicularly to each other.

European patent application No. 0 064 799 describes a ceramic resonator element disposed in a cavity in order to form a composite microwave resonator. Two tuning screws situated in the cavity along orthogonal axes serve to tune the assembly along said axes to frequencies close to the fundamental resonance frequency of the resonator element. A plurality of cavities of this type may be assembled together to form a waveguide by using a plurality of transverse separations. Coupling between these various cavities can then be provided by means of single slots, by a pair of slots in a cross configuration, or by using circular irises. An adjustment screw is positioned in each cavity along an axis at 45° relative to the oorthogonal tuning screws in such a manner that resonance along each of the orthogonal axes is coupled to resonance along the other axis.

However, these prior art documents give no details concerning:

the position of the resonator in the metal cavity;

the material used to make the cavity, the adjustment devices, and the resonator holding system; and the principle whereby the dielectric resonator is held within the cavity.

In other prior art documents, various details are given concerning the materials used for the cavity:

utilization of invar and carbon fiber; or utilization of some other material with the coefficients of expansion used being compensated.

As for the holding dielectric, few precise solutions are given, e.g.:

low loss insulating materials (polystryene or PTFE (polytetrafluorethylene), foam) in the form of a column or a cushion.

While ensuring that it is possible to optimize the response curves of filters having dielectric resonators in a band close to resonance and over a wide band, the invention has the object of solving various questions raised in the manufacture of such filters.

SUMMARY OF THE INVENTION

To this end, the present invention provides a filter having a dielectric resonator, the filter comprising at least one cylindrical cavity containing a cylindrical dielectric resonator whose axis of symmetry is colinear with the axis of said cavity, wherein the resonator is held in a longitudinally asymmetrical position inside said cavity by a mandrel system which clamps around the cylindrical portion thereof and which includes at least one spoke for fixing it to said cavity while leaving play relative to said cavity.

Such a filter has numerous advantages, namely:

it makes it possible to obtain a sufficient frequency difference between the $HE_{1,18}$ mode, for example, and the other modes to make it possible to obtain a fairly wide band which is free of parasitic modes;

the coupling slots remain small in size, thereby greatly reducing parasitic coupling; and it makes it possible to design filters with a more than two-mode structure.

More particularly, the invention relates to a filter having a dielectric resonator, in which:

the cavity is closed at at least one of its ends by an iris; and the resonator is held by a system including a mandrel fixed to the inside wall of the cavity by three spokes at 120° intervals, with one of them constituting a fixed point and with the other two leaving play between the cavity and the mandrel system via resilient seals for absorbing any radial stress due to differential expansion.

Advantageously, this mandrel system may comprise three cylindrical parts:

a first part terminating at a first longitudinal end in a conical inside bearing surface and at its second end in a threaded inside bearing surface;

a second, moving part situated inside said first part and having an outer sloping bearing surface suitable for sliding against the conical bearing surface; and a threaded part engaged in the threaded bearing surface of the first part.

Advantageously, the mandrel system and the screws are made of dielectric material, and the cavity is made of silver-plated aluminum as are each of the irises.

These characteristics make it possible:

to optimize the Q-factor (no lossy material in the critical zones); and to obtain a temperature stability coefficient of about 4 ppm/°C. (where ppm means parts per million), which can be compensated by using a dielectric resonator having a −4 ppm/°C. characteristic.

In addition, it is possible to use cylindrical resonators in such a filter without specially machining the resonators, with this mandrel system having the advantage of being identical regardless of the lengths of the cavities and the resonators, and this constitutes a major industrial advantage e.g. when a high number of channels are being used (multiplexers).

BRIEF DESCRIPTION OF THE DRAWINGS

An embodiment of the invention is described by way of example with reference to the accompanying drawings, in which.

MORE DETAILED DESCRIPTION

Figure 1:
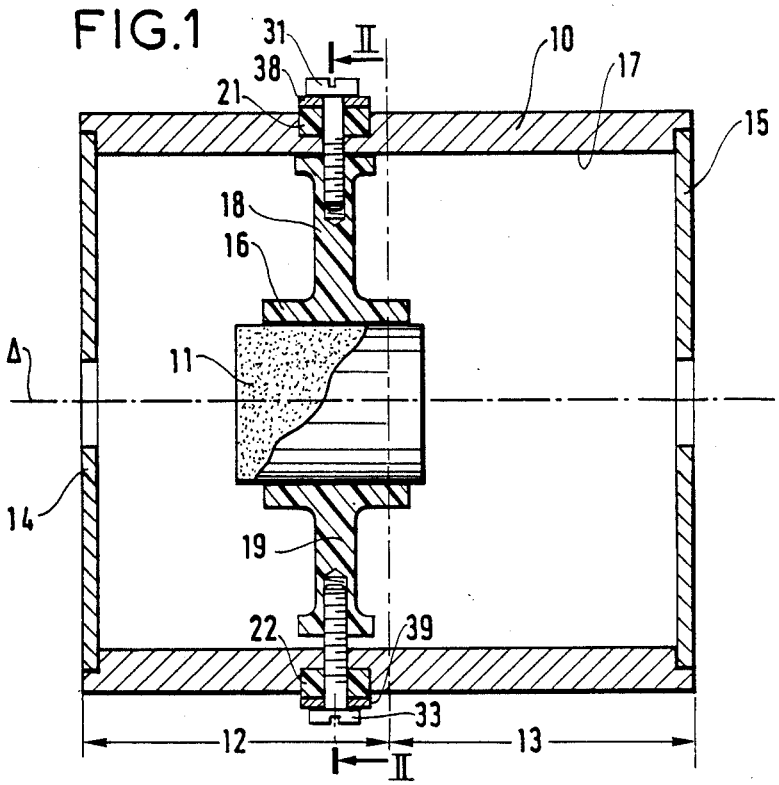
FIG. 1 is a diagrammatic longitudinal section view on plane I—I of FIG. 2 through a filter in accordance with the invention.

As shown in FIG. 1, a resonant filter in accordance with the invention is constituted by a cylindrical cavity 10 having a cylindrical dielectric resonator 11 therein, with the axis of symmetry Δ of the resonator being colinear with the axis of symmetry of said cavity 10.

In this case, the resonator 11 is located longitudinally asymmetrically inside the cavity 10.

The cavity 10 is closed, for example, by two irises 14 and 15.

The resonator 11 is held inside the cavity 10 by a mandrel system 16 which surrounds the cylindrical portion thereof.

Figure 2:
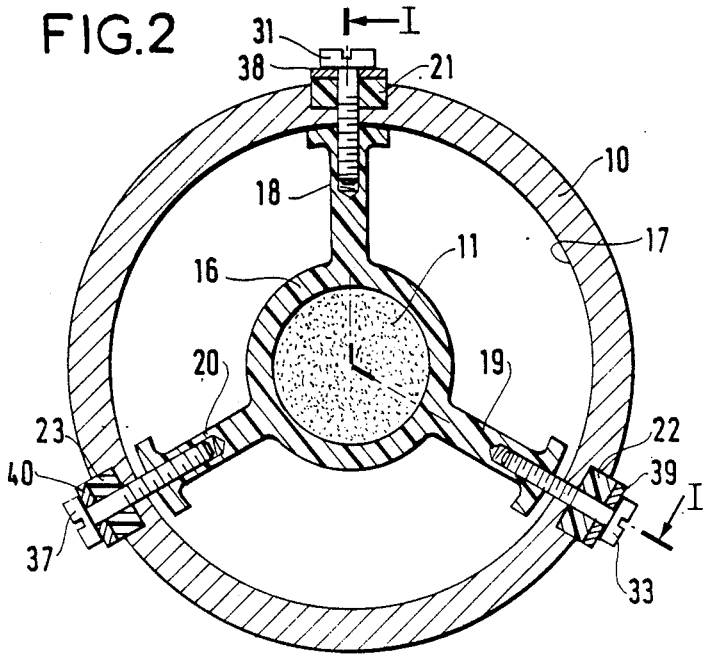
FIG. 2 is a diagrammatic cross-section view on plane I—I of FIG. 1 through a filter in accordance with the invention.

As shown in FIG. 2, this mandrel system is fixed to the inside wall 17 of the cavity via three spokes 18, 19, and 20 at 120° intervals from one another, with one of the spokes 18, being fixed against said wall 17, and with the other two spokes 19 and 20 leaving play between the wall 17 and the mandrel system 16 via resilient seals 22 and 23 which serve to absorb any radial stress that may arise due to differential expansion.

Advantageously, these three spokes 18, 19, and 20 are identical.

Figure 3:
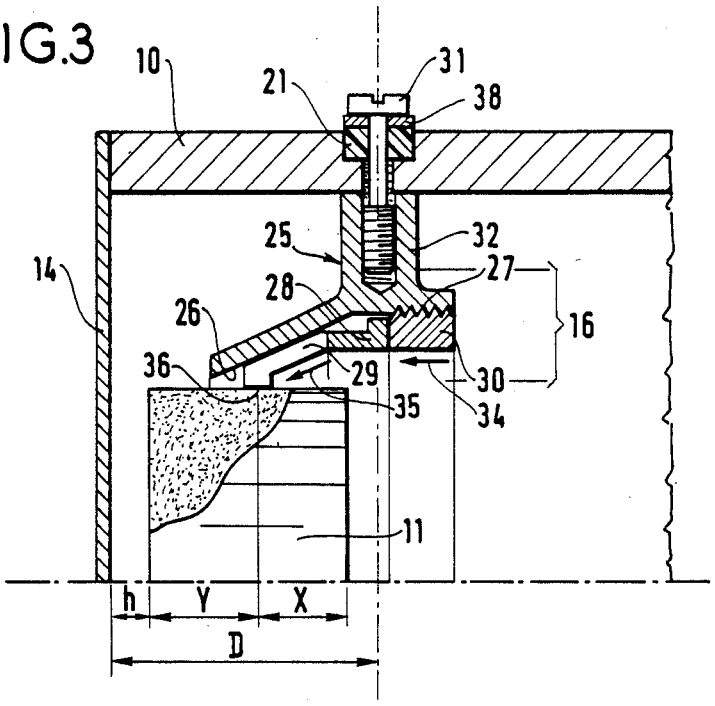
FIG. 3 is a diagrammatic detail view of one embodiment of a filter in accordance with the invention.

In one particular embodiment, shown in part in FIG. 3, the mandrel system 16 may be constituted by three cylindrical parts:

a first part 25 terminating at a first longitudinal end in an internal conical bearing surface 26, and at its second end in a threaded internal bearing surface 27;

a second part 28 moving inside said first part 25 and having a sloping outer bearing surface 29 suitable for sliding against the above-mentioned conical bearing surface 26; and a threaded part 30 engaged in the threaded bearing surface of the first part 25.

The first part includes three outer end fittings at 120° intervals from one another and having internal threads for receiving three screws 31, 33, and 37, with each screw bearing against a metal washer 38, 39, or 40 which rests against a seal made of resilient material 21, 22, or 23 and serving to compensate thermal expansion of the materials from which the filter is made. FIG. 3 shows only one, 31, of these three screws 31, 33, and 37, which screw is received in a threaded end fitting 32 and rests against the washer 38.

When the threaded part 30 is screwed (34) into the threaded portion of the first part 25, the inclined bearing surface 29 of the second part 28 moves (35) along the conical bearing surface 26 of the first part 25, thereby providing perpendicular clamping against the cylindrical portion 36 of the resonator.

In the device of the invention, it is assumed that the cavities and the adjustment devices used are made of silver-plated aluminum.

In a particular embodiment, the filter of the invention has the following characterisitics:

the resonator 11 is held by a mandrel system whose clamping couple is determined so as to withstand accelerations of up to 30 g and so as to withstand considerable thermal stresses; and the mandrel system is held inside the aluminum cavity by three screws made of dielectric material and disposed at 120° intervals to one another. One of these screws constitutes a fixed point (and provides contact between the cavity and the mandrel system), while the other two screws leave play between the cavity and the mandrel system. Clamping is obtained at these points by three identical seals which serve to absorb the radial stresses that are obtained because of differential expansion. Unless they are minimized, these stresses set up an umbrella effect moving the resonator towards one or other of the ends of the cavity, thereby changing its resonant frequency.

In a particular embodiment, the component parts of the filter of the invention have the following dimensions:

resonator:
- diameter 16 mm
- length 8.4 mm cavity:
- inside diameter 32 mm
- length ≈ 21 mm position of the resonator inside the cavity:
- h = 1.5 mm (distance between the end of the resonator and the iris)
- D ≈ 10 mm (distance between the iris and the fixing)
- X ≈ 2.8 mm (distance between the fixing and the point where the resonator is held)

iris coupling slot:
- width ≈ 2 mm
- length ≈ 6 mm material used:
- cavity made of aluminum
- iris made of aluminum
- fixing made of dielectric material The clamping couple holding the resonator to the mandrel should then be about 25 cm.Newton.

Figure 4:
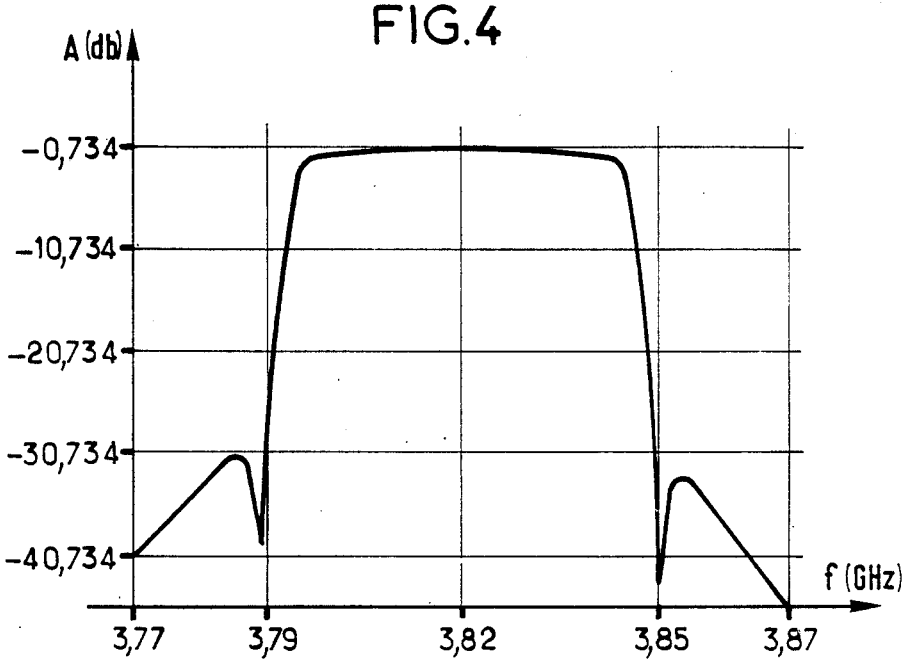
FIG. 4 shows the response curve of a particular embodiment of a filter in accordance with the invention.

A plurality of cavities in accordance with the invention may be connected end-to-end in order to constitute an n-pole filter. Thus, the above-defined characteristics make it possible to put four cavities end-to-end in order to constitute a self-correcting 8-pole filter in the 3.7 GHz/4.2 GHz band whose performance is given by the curve in FIG. 4 which is a plot of the gain transfer parameter (in decibels) as a function of frequency (in gigarhertz).

Naturally, the present invention has been described and shown merely by way of preferred example and its component parts could be replaced by equivalent parts without thereby going beyond the scope of the invention.

We claim:

1. A filter comprising a member including at least one cylindrical cavity, symmetrical about one axis, a cylindrical dielectric resonator having an axis colinear with the axis of said cavity, a mandrel clamped around the cylindrical dielectric resonator for holding said resonator in a longitudinally asymmetrical position inside said cavity and including at least two radially outwardly projecting spokes at circumferentially spaced positions thereon including at least one first spoke and at least one second spoke, means for connecting said spokes to said member including first means for fixing a radially outboard end of said first spoke to said member defining the cylindrical cavity, and second means for connecting a radially outboard end of said at least one second spoke to said member defining said cylindrical cavity with a radial gap between said second spoke member permitting radial play between said member defining said cylindrical cavity and said mandrel.

2. A filter according to claim 1, wherein the cavity is closed at at least one of its ends by an iris.

3. A filter according to claim 1, wherein said mandrel comprises three spokes at 120° circumferentially spaced positions, said first spoke constituting a fixed point connection between said mandrel and said member defining the cylindrical cavity, and said other two spokes constituting two second spokes, and wherein said means connecting the outboard end of said second spoke to said member defining the cylindrical cavity including resilient seals for absorbing radial stress occurring due to differential expansion between said mandrel and said member including the cylindrical cavity.

4. A filter according to claim 3, wherein the mandrel is constituted by three cylindrical parts:

a first part terminating at a first longitudinal end in a conical inside bearing surface and at its second end in a threaded inside bearing surface;

a second, moving part situated inside said first part and having an outer sloping bearing surface suitable for sliding against the conical bearing surface; and a threaded part engaged in the threaded bearing surface of the first part.

5. A filter according to claim 3, wherein the three spokes are constituted by three internally threaded outwardly directed end fittings suitable for receiving three screws, with at least two of these spokes bearing against respective washers which rest on seals made of resilient material enabling thermal expansion of the filter-constituting materials to be compensated.

6. A filter according to claim 1, wherein the mandrel and the spokes are made of dielectric material.

7. A filter according to claim 1, wherein the cavity is made of silver-plated metal.

8. A filter according to claim 1, wherein each iris is made of silver-plated metal.

* * * * *